US007157200B2

(12) United States Patent
Mc Stravick et al.

(10) Patent No.: US 7,157,200 B2
(45) **Date of Patent: *Jan. 2, 2007**

(54) EMULSION AGGREGATION BLACK TONER AND DEVELOPER WITH SUPERIOR IMAGE QUALITY

(75) Inventors: Mary L. Mc Stravick, Fairport, NY (US); Paul C. Julien, Webster, NY (US); Sue E. Blaszak, Fairport, NY (US); William H. Hollenbaugh, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 328 days.

This patent is subject to a terminal disclaimer.

(21) Appl. No.: 10/839,293

(22) Filed: May 6, 2004

(65) Prior Publication Data

US 2005/0250030 A1 Nov. 10, 2005

(51) Int. Cl.
*G03G 9/087* (2006.01)

(52) U.S. Cl. ..... 430/108.6; 430/109.3; 430/108.7; 430/111.41

(58) Field of Classification Search ..... 430/108.6, 430/109.3, 108.7, 111.41
See application file for complete search history.

(56) References Cited

U.S. PATENT DOCUMENTS

| | | | | |
|---|---|---|---|---|
| 3,981,272 | A | 9/1976 | Smith et al. | |
| 4,155,329 | A | 5/1979 | Tsukamoto et al. | |
| 4,375,673 | A | 3/1983 | Lewis et al. | |
| 4,465,730 | A | 8/1984 | Okada | |
| 5,009,979 | A * | 4/1991 | Buxton et al. | 430/108.21 |
| 5,236,629 | A | 8/1993 | Mahabadi et al. | |
| 5,345,298 | A | 9/1994 | Corrigan, Jr. | |
| 5,416,566 | A | 5/1995 | Edmunds et al. | |
| 5,545,501 | A | 8/1996 | Tavernier et al. | |
| 5,847,030 | A | 12/1998 | Mahabadi et al. | |
| 6,087,059 | A * | 7/2000 | Duggan et al. | 430/108.22 |
| 6,120,967 | A | 9/2000 | Hopper et al. | |
| 6,319,647 | B1 | 11/2001 | Gutman et al. | |
| 6,416,916 | B1 | 7/2002 | Silence et al. | |
| 6,503,677 | B1 * | 1/2003 | Gutman et al. | 430/108.3 |

* cited by examiner

*Primary Examiner*—John L Goodrow
(74) *Attorney, Agent, or Firm*—Oliff & Berridge PLC

(57) ABSTRACT

A black toner of toner particles including at least one binder, at least one black colorant, and a package of external additives is described, wherein the at least one binder includes a styrene acrylate binder and wherein the external additives include each of a first silica having an average particle size of from about 35 to about 45 nm, a second silica having an average particle size of from about 135 to about 160 nm, and a titania having an average particle size of from about 35 to about 45 nm. Also described is a developer that includes the black toner and carrier particles comprising a core of ferrite coated with a coating comprising a polymethyl methacrylate polymer and fluoro-copolymer, carbon black and melamine beads. The black toner and developer are preferably used in a semiconductive magnetic brush development system.

15 Claims, No Drawings

EMULSION AGGREGATION BLACK TONER AND DEVELOPER WITH SUPERIOR IMAGE QUALITY

BACKGROUND OF THE INVENTION

1. Field of Invention

This invention relates to black toner, developer containing the black toner, and a method of forming images with the developer utilizing a semiconductive magnetic brush development system. More in particular, the invention relates to black toner having specific toner particle and external additive compositions and properties such that the toner, following triboelectric contact with a carrier, exhibits a triboelectric charge of from about 35 to about 75 μC/g so as to provide a black toner image of superior image quality when used to develop electrostatic images in a semiconductive magnetic brush development system.

2. Description of Related Art

U.S. Pat. No. 5,545,501 describes an electrostatographic developer composition comprising carrier particles and toner particles with a toner particle size distribution having a volume average particle size (t) (such that 4 μm≦t≦12 μm and an average charge (absolute value) per diameter in femtocoulomb/10 μm ($C_T$) after triboelectric contact with said carrier particles such that 1 fC/10 μm≦$C_T$≦10 fC/10 μm characterized in that (i) said carrier particles have a saturation magnetization value, $M_{sat}$, expressed in Tesla (T) such that $M_{sat}$≧0.30 T, (ii) said carrier particles have a volume average particle size ($C_{avg}$) such that 30 μm≦$C_{avg}$≦60 μm, (iii) said volume based particle size distribution of said carrier particles has at least 90% of the particles having a particle diameter C such that 0.5 $C_{avg}$≦C≦2 $C_{avg}$, (iv) said volume based particles size distribution of said carrier particles comprises less than b % particles smaller than 25 μm wherein $b=0.35\times(M_{sat})^2\times P$ with $M_{sat}$=saturation magnetization value, $M_{sat}$, expressed in T and P=the maximal field strength of the magnetic developing pole expressed in kA/m, and (v) said carrier particles comprise a core particle coated with a resin coating in an amount (RC) such that 0.2% w/w≦RC≦2% w/w. See the Abstract. This patent describes that such developer achieves images of offset-quality in systems in which a latent image is developed with a fine hair magnetic brush. See column 4, lines 7–17 of the patent.

U.S. Pat. No. 6,319,647 describes a toner of toner particles containing at least one binder, at least one colorant, and preferably one or more external additives that is advantageously formed into a developer and used in a magnetic brush development system to achieve consistent, high quality copy images. The toner particles, following triboelectric contact with carrier particles, exhibit a charge per particle diameter (Q/D) of from 0.6 to 0.9 fC/μm and a triboelectric charge of from 20 to 25 μC/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidenefluoride polymer or copolymer and a polymethyl methacrylate polymer or copolymer.

U.S. Pat. No. 6,416,916 describes a toner of toner particles containing at least one binder, at least one colorant, and an external additive package comprised of zinc stearate and at least one of silicon dioxide or titanium dioxide, wherein the amount of zinc stearate is limited to about 0.10 percent by weight or less of the toner. It is reported that when the amount of zinc stearate is so limited, a developer formed from the toner exhibits excellent triboelectric charging and stability and excellent developer flow. When the developer is used in a magnetic brush development system, consistent, high quality copy images are formed substantially without any depletion defects over time.

What is still desired is a black toner for use in semiconductive magnetic brush development systems, which toner is able to develop a large number of pages per minute with substantially reduced emissions and high print quality.

SUMMARY OF THE INVENTION

This and other objects are achieved in the present invention with a toner comprised of toner particles of at least one binder, at least one black colorant, and a package of external additives, wherein the at least one binder includes a styrene acrylate binder including a cross-linked styrene acrylate gel content of from 0% to about 15% by weight of the binder, and wherein the external additives include from about 0.2 to about 5.0% by weight of the toner particles of a first silica having an average particle size of from about 35 to about 45 nm, from about 0.2 to about 3.0% by weight of the toner particles of a second silica having an average particle size of from about 135 to about 160 nm, and from about 0.2 to about 5.0% by weight of the toner particles of a titania having an average particle size of from about 35 to about 45 nm.

In embodiments, the toner particles may further include a third silica having an average particle size of from about 8 to about 20 nm, and in the amount of from about 0.2 to about 5% by weight of the toner particles.

In embodiments, the invention further relates to a developer comprising the aforementioned black toner and carrier particles comprised of a core of ferrite coated with a coating comprising a polymethyl methacrylate polymer or polymethyl methacrylate and fluoro-copolymer mixture, carbon black and melamine beads, wherein the developer comprises from about 1 part to about 25 parts by weight of the black toner and from about 75 parts to about 99 parts by weight of the carrier particles.

In still further embodiments, the invention relates to an electrophotographic image forming apparatus comprising a photoreceptor, a semiconductive magnetic brush development system, and a housing in association with the semiconductive magnetic brush development system for containing a developer comprising the black toner of the invention.

DETAILED DESCRIPTION OF PREFERRED EMBODIMENTS

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., and of an original document being reproduced. This records an electrostatic latent image on the photoconductive surface of a photoreceptor. After the electrostatic latent image is recorded on the photoconductive surface, the latent image is developed with a toner or developer containing a toner.

In the present invention, a two-component developer is used for development. A typical two-component developer comprises magnetic carrier particles with toner particles triboelectrically attracted thereto. During development of the latent image, the toner particles are attracted to the latent image, forming a toner powder image on the photoconductive surface. The toner powder image is subsequently transferred to an image transfer medium, e.g., a sheet of paper or a transparency. Finally, the toner powder image is heated to permanently fuse it to the image transfer medium.

A commonly known way of developing the latent image on the photoreceptor is by use of one or more magnetic brushes. See, for example, U.S. Pat. Nos. 5,416,566, 5,345,298, 4,465,730, 4,155,329 and 3,981,272, incorporated herein by reference. The toner of the developer may be formulated to carry either a negative or positive charge, and is in any case selected vis-a-vis the carrier so that the toner particles acquire the proper operating charge with respect to the latent electrostatic image being developed. Thus, when the developer is brought into operative contact with the photoconductive surface of the photoreceptor, the greater attractive force of the discharged image causes the toner particles to leave the carrier particles and adhere to the image portion of the photoconductive surface.

The previously mentioned magnetic brush typically is comprised of a roll having a tube-like member or sleeve, which is rotatably supported. The sleeve is preferably made from a non-magnetic material, more preferably stainless steel, which is conductive and allows less eddy currents than aluminum so that localized heating is reduced. One or more magnets are mounted inside the sleeve. The roll is disposed so that a portion of the sleeve is immersed in or in contact with a supply of developer comprising the carrier particles and the toner particles.

As a result, the developer is made to be attracted to the surface of the sleeve and arranges thereupon in the form of a brush, e.g., as bristles of a brush. Thus, when the photoreceptor bearing the latent electrostatic image thereon is brought into physical contact with the brush, the attractive force of the electrostatic charge on the photoreceptor surface in the image areas, which is greater than the force holding the toner particles is association with the brush, draws the toner particles from the magnetic brush roller and onto the image areas to render the image visible.

The electrophotographic marking process given above is ideal for single color images, i.e., conventional black toner images. In such process, the toner particles are colored black by way of a black colorant included in the toner particles.

This invention describes the aspects of novel black toners and developers that operate in the restrictive semiconductive magnetic brush development environment to achieve image qualities superior to prior art toners and developers with the capability of forming a large number of prints per minute with reduced emissions. As a result of the reduced emissions with the toner of the present invention, solid and halftone areas are uniform and stable in density and color, and text is crisp with well-defined edges regardless of font size or type. In addition, background toner in non-image areas is reduced and machine dirt and contamination is minimized.

The black toner of the present invention is comprised of at least one resin binder, at least one black colorant and an external additive package comprised of one or more particulate additives. Suitable and preferred materials for use in preparing the black toner of the invention will now be discussed.

In the black toner of the present invention, the resin binder of the toner particles is preferably comprised of an acrylate binder, more preferably a styrene acrylate binder, most preferably of an emulsion aggregation styrene acrylate binder.

The emulsion aggregation styrene acrylate binder may be prepared by any suitable emulsion aggregation process. As one example, reference is made to U.S. Pat. No. 6,120,967, incorporated herein by reference in its entirety.

The styrene acrylate binder may be made to include some amount of cross-linked gel portions therein. These cross-linked gel portions are comprised of cross-linked binder distributed as microgel particles throughout the linear portions of the binder. Such cross-linked gel portions have a volume average particle size of from, for example, 0.1 μm or less, preferably about 0.005 to about 0.1 μm, as determined by scanning electron microscopy and/or transmission electron microscopy.

The binder resin preferably has a weight fraction of the microgel (cross-linked gel portion content) in the range from 0 to about 15% by weight of the binder, preferably from about 1 to about 12% by weight of the binder, more preferably from about 5 to about 11% by weight of the binder, most preferably about 10% by weight of the binder. The linear portion is comprised of base resin, preferably styrene acrylate, in the range from about 50 to about 100% by weight of the binder, and preferably in the range from about 65 to about 100% by weight of the binder. The linear portion of the binder resin preferably comprises low molecular weight reactive base resin that did not cross-link during a cross-linking reaction. The molecular weight distribution of the styrene acrylate binder resin is thus bimodal, having different ranges for the linear and the cross-linked portions of the binder resin.

The binder may also include some amount of additional binder materials such as comprised of, for example, vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like.

The binder of the toner particles is melt blended or otherwise mixed with at least one black colorant. Various black colorants may be used without limitation, and the colorant may be a pigment, dye or mixture thereof. Example black colorants include, for example, carbon black such as REGAL 330 carbon black (Cabot), acetylene black, lamp black, aniline black and mixtures thereof. Most preferably, the colorant is a carbon black pigment having a suitable particle size such as, for example, about 50 to about 250 nm, and may be in the form of a dispersion, for example an aqueous dispersion.

The black colorant is preferably included in the toner composition in an amount of from about 1% to about 25% by weight of the toner particles, preferably from about 5% to about 15% by weight of the toner particles, most preferably from about 8 to about 12% by weight of the toner particles.

The toner particles of the present invention may also include several additional optional additives within the toner particles (e.g., internal additives). For example, as required, the toner particles may also include charge control additives, surfactants, emulsifiers, pigment dispersants, flow additives, and the like. A wax, such as polyethylene, polypropylene, and/or paraffin wax, can also be included in or on the toner composition as fusing release agents.

The toner particles of the present invention preferably have a small size. In particular, the toner particles preferably have an average particle size of from about 3 μm to about 10 μm, preferably from about 4 μm to about 7 μm, most preferably from about 5 μm to about 6 μm.

The toner particles also must have an external additive package on the surface of the toner particles.

Preferably, the external additive package comprises at least a first silica having an average particle size of from about 35 to about 45 nm, a second silica having an average particle size of from about 135 to about 160 nm, and a titania having an average particle size of from about 35 to about 45 nm.

The first silica (also known as $SiO_2$ or silicon dioxide) is preferably present in the toner particles in an amount of from about 0.2 to about 5.0% by weight of the toner particles, preferably from about 0.5 to about 2.0% by weight of the toner particles. This first silica particle preferably has an average particle size of about 40 nm. In general, silica is applied to the toner surface for toner flow, triboelectric enhancement, admix control, improved development and transfer stability and higher toner blocking temperature. It has been found that the aforementioned amounts of the sized first silica in the toner particles can increase the toner particles triboelectric charge in use and can also increase the charge per particle diameter (q/d) of the toner in use. Silica particles of the aforementioned size range are commercially available, for example from DeGussa.

The second silica is preferably present in the toner particles in an amount of from about 0.2 to about 3.0% by weight of the toner particles, preferably from about 0.6 to about 2.4% by weight of the toner particles. This second silica particle preferably has an average particle size of about 140 nm to about 150 nm. It has been found that this second silica may increase the cohesion of the toner particles, but not to an extent that is unacceptable within the aforementioned amount ranges. The second silica does not negatively affect the triboelectric charging or q/d properties of the toner particles.

The presence of these ultra large size second silica particles is desirable in order to prevent impaction of the smaller sized external additives into the toner particles during use of the toner. During use, carrier particles knock into the toner particles, and such impacts can force smaller external additives to become undesirably impacted into the surface of the toner particles. The larger sized second silica particles absorb the impacts, and are of a sufficiently large size themselves to be less susceptible to complete impaction into the toner particles. The presence of the second silica particles thus ensures maintained development and transfer performance of the toner over time.

The second silica particles are preferably sol-gel silica particles. The second silica particles are commercially available, for example from Shin-Etsu.

The titania particles (also known as $TiO_2$ or titanium dioxide) is preferably present in the toner particles in an amount of from about 0.2 to about 5.0% by weight of the toner particles, preferably from about 0.2 to about 1.2% by weight of the toner particles. This titania particles preferably have an average particle size of about 40 μm. In general, titania is added to the surface of the toner particles for improved relative humidity (RH) stability, triboelectric control and improved development and transfer stability. Titania particles of the aforementioned size range are commercially available, for example from Tayca.

Optionally, a third silica may be present in the toner particles in an amount of from about 0.2 to about 5.0% by weight of the toner particles. This third silica particle preferably has an average particle size of about 8 nm to about 20 nm. The third silica may contribute to improved charging and flowability. Example suitable silicas in the size range of 8 nm to 20 nm and are commercially available from Degussa and Cabot Corporation.

Additional external surface additives may also be included in the external surface additive package. For example, the external additive package may also include ZnSt (zinc stearate). Zinc stearate provides lubricating properties, provides developer conductivity and triboelectric enhancement, both due to its lubricating nature, and can enable higher toner charge and charge stability by increasing the number of contacts between toner and carrier particles. Calcium stearate and magnesium stearate may also be added to provide similar functions. A suitable commercially available zinc stearate is known as Zinc Stearate L made by Ferro Corporation, Polymer Additives Division.

The aforementioned external additives may be rendered hydrophobic, if necessary, by surface treatments to reduce the humidity sensitivity of the toner charging. The first silica and titania, for example, may be treated with PDMS (polydimethyl siloxane). The second silica may be treated with, for example, an organic silane.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives may be incorporated into the toner in an amount of from about 0.1 percent by weight to about 20 percent by weight, and preferably from 1 to about 3 percent by weight, of the toner particles.

The following Table 1 sets forth several preferred toner compositions of the present invention. All amounts are percentages by weight, based on the total weight of the toner particles.

TABLE 1

| Example | First small size silica | Second large size silica | Titania |
|---|---|---|---|
| 1 | 0.57 | 0.74 | 0.37 |
| 2 | 1.71 | 0.74 | 0.37 |
| 3 | 0.57 | 0.74 | 1.10 |
| 4 | 1.71 | 0.74 | 1.10 |
| 5 | 0.57 | 2.22 | 0.37 |
| 6 | 1.71 | 2.22 | 0.37 |
| 7 | 0.57 | 2.22 | 1.10 |
| 8 | 1.71 | 2.22 | 1.10 |

The toner composition of the present invention can be prepared by a number of known methods, for example including melt blending the toner resin particles, colorants and optional internal additives followed by mechanical attrition. Other methods include those well known in the art such as spray drying, melt dispersion, dispersion polymerization, suspension polymerization, emulsion aggregation and extrusion. The toner is preferably made by first mixing the binder, preferably comprised of both the linear resin and the cross-linked resin as discussed above, and the colorant together in a mixing device. The toner is then classified to form a toner with the desired volume median particle size. Care should be taken in the method in order to limit the coarse particles, grits and giant particles. Subsequent toner blending of the external additives is preferably accomplished using a mixer or blender, for example a Henschel mixer, followed by screening to obtain the final toner product.

Following formation, the toner particles may optionally be washed with an acid, e.g., calcium chloride. Such acid washing can improve the relative humidity sensitivity of the toner particles but can also lower triboelectric charging values of the toner particles. Water washing, which does not substantially affect the toner particle properties, may alternatively be used.

The charge of a toner is described in terms of the charge/particle diameter, q/d, in fC/μm following triboelectric contact of the toner with carrier particles. The charge per particle diameter (q/d) of the toner particles preferably has an average value of from, for example, 0.1 to 1.0 fC/μm, corresponding to a 5.5 μm toner tribo of 10 μcoul/gram to 80 μcoul/gram. This charge should remain stable throughout the development process in order to insure consistency in the richness of the images obtained using the toner. The measurement of the average q/d of the toner particles can be done by means of a charge spectrograph apparatus as well known in the art. See, for example, U.S. Pat. No. 4,375,673, incorporated herein by reference. The spectrograph is used to measure the distribution of the toner particle charge (q in fC) with respect to a measured toner diameter (d in μm).

In a most preferred embodiment of the present invention, the toner particles exhibit a triboelectric value (as measured by the known Faraday Cage process), after triboelectric contact with carrier particles, of from, for example, about −25 to about −80° C./g, more preferably about −38 to about −50° C./g as measured in 70° F. and 50% relative humidity, as well as exhibits triboelectric stability over the life of the developer.

The toner is most preferably incorporated into a two component developer composition as discussed above by mixing with appropriate carrier particles.

Suitable and preferred materials for use as carriers used in preparing developers containing the above-discussed toners of the invention that possess the properties discussed above will now be discussed. The toner particles triboelectrically associate and/or adhere to the surface of the carrier particles.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other suitable carriers are disclosed in U.S. Pat. Nos. 4,937,166 and 4,935,326, the disclosures of which are hereby totally incorporated by reference.

In a preferred embodiment, the carrier core is comprised of ferrite particles. Any commercially available ferrite carrier may be used without restriction. Preferably, the carrier core may be comprised of a manganese magnesium ferrite core, such as commercially available from Powder Tech. The ferrite particles to be used as carrier cores in the developer composition preferably have an average particle size (diameter) of from, for example, 10 to 100 μm, preferably 20 to 70 μm, most preferably 25 to 40 μm, as determined by standard laser diffraction techniques.

The selected carrier particles can be used with or without a coating. In a preferred embodiment of the developer composition, the carrier particles are coated with a polymethyl methacrylate polymer or copolymer.

In another preferred embodiment, the ferrite carrier particles are coated with a mixture of at least two dry polymer components, which dry polymer components are preferably not in close proximity thereto in the triboelectric series, and most preferably of opposite charging polarities with respect to the toner selected. The electronegative polymer, i.e., the polymer that will generally impart a positive charge on the toner with which it is contacted, is preferably comprised of a polyvinylidenefluoride polymer or copolymer. Such polyvinylidenefluoride polymers are commercially available, for example under the tradename KYNAR. The electropositive polymer, i.e., the polymer that will generally impart a negative charge on the toner with which it is contacted, is preferably comprised of a polymer or copolymer of polymethyl methacrylate (PMMA), optionally having carbon black or another conductive material dispersed therein. PMMA by itself is an insulative polymer. To obtain a conductive carrier coating, a conductive component, for example carbon black, is dry blended with the PMMA and any other carrier coating constituents. The mixture is then tumbled onto the core and fused.

The PMMA may be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, t-butylaminoethyl methacrylate, and the like. If the PMMA polymer has carbon black dispersed therein, it is preferably formed in a semisuspension polymerization process, for example as described in U.S. Pat. No. 5,236,629, incorporated by reference herein in its entirety.

In a preferred embodiment of the invention, the carrier is coated with a PMMA coating such as described in U.S. Pat. No. 5,847,030, incorporated herein by reference in its entirety. Preferably, such PMMA is made by an emulsion polymerization process and has a narrow particle size distribution with polymer particles in the 100 to 200 nm size range, preferably about 150 nm. This small size is desirable to provide uniform coverage on the small ferrite core.

The percentage of each polymer present in the carrier coating can vary depending on the specific components selected, the coating weight and the properties desired. For example, the ratios of the two polymers may be varied in order to adjust the triboelectric characteristics of the carrier in order to meet the particular requirements of a given printing device. Generally, the coated polymer mixtures used contain from about 3 to about 97 percent of the electronegative polymer, and from about 97 to about 3 percent by weight of the electropositive polymer. Preferably, there are selected mixtures of polymers with from about 3 to 25 percent by weight of the electronegative polymer, and from about 97 to 75 percent by weight of the electropositive polymer. Most preferably, there are selected mixtures of polymers with from about 5 to 15 percent by weight of the electronegative polymer, and from about 95 to 85 percent by weight of the electropositive polymer.

In a most preferred embodiment, the coating on the carrier particles includes from about 70 to about 80% by weight of a polymethyl methacrylate polymer, from about 6 to about 12% by weight of carbon black and from about 8 to about 12% by weight of melamine beads, and most preferably the coating further includes from about 3 to about 9% of a fluoro-copolymer.

As noted above, the coating on the ferrite carrier particles preferably also includes melamine beads, for example melamine beads having an average particles size of from about 100 nm to about 300 nm. Such beads are commercially available from, for example, Nippon Shokubai. The melamine beads may comprise of from about 5 to about 15% by weight of the total coating, more preferably from about 8 to about 12% by weight of the total coating. The melamine beads may provide charging and conductivity stability.

The carrier particles may be prepared by mixing the carrier core with from, for example, between about 0.05 to about 10 percent by weight, most preferably between about 0.3 percent and about 5.0 percent by weight, based on the weight of the coated carrier particles, of the coating composition until adherence thereof to the carrier core by mechanical impaction and/or electrostatic attraction. The mixture of carrier core particles and polymers is then heated to an elevated temperature for a period of time sufficient to melt and fuse to the coating polymers to the carrier core particles. The coated carrier particles are then cooled and thereafter classified to a desired particle size. The coating preferably has a coating weight of from, for example, 0.1 to 5.0% by weight of the carrier, preferably 0.1 to 3.0% by weight.

Various effective suitable methods can be used to apply the polymer mixture coatings to the surface of the carrier core particles. Examples of typical methods for this purpose include combining the carrier core material and the coating composition by cascade roll mixing, or tumbling, milling, shaking, electrostatic powder cloud spraying, fluidized bed, electrostatic disc processing, and an electrostatic curtain.

The coated carrier particles preferably have a size of from about 25 μm to about 40 μm, more preferably of about 35 μm. In a preferred embodiment, it is desirable to maintain a ratio of carrier volume median diameter to toner volume median diameter of approximately 5:1 to 9:1.

Two component developer compositions of the present invention can be generated by mixing the carrier core particles with the toner composition discussed above. The carrier particles can be mixed with the toner particles in various suitable combinations. However, best results are obtained when from about 1 part to about 25 parts by weight of the black toner and from about 75 parts to about 99 parts by weight of the carrier particles, are mixed. The toner concentration in the developer initially installed in a xerographic development housing is thus preferably between, for example, about 1 to about 20% by weight based on the total developer weight.

The developers of the invention exhibit superior black image quality, reduced emissions, and enable the device to print a large number of pages per minute (ppm), for example on the order of 40 to 200 ppm or more, without quality problems arising.

Table 2 below summarizes the triboelectric and cohesion properties obtained for the Example toners identified in Table 1 above.

TABLE 2

| Example | Tribo (15 min PS) (μC/g) | Tribo (60 min PS) (μC/g) | Cohesion |
|---|---|---|---|
| 1 | −36.1 | −27.2 | 73 |
| 2 | −41.9 | −36.4 | 82 |
| 3 | −35.5 | −26.6 | 38 |
| 4 | −39.2 | −35.2 | 65 |
| 5 | −33.6 | −22.4 | 33 |
| 6 | −43.5 | −27.2 | 57 |
| 7 | −29.5 | −21.9 | 18 |
| 8 | −32.4 | −23.6 | 40 |

To determine the tribo, a 0.5 gram sample of developer is placed in a Faraday cage. Pressurized air is blown through the cage that has screens at each end. The screen size allows toner to escape and retains carrier. 25 micron screen works best for 35 micron carrier and 5.5 micron toner. An electrometer is attached to the cage and monitors charge change as toner exits the cage. The weight change is measured from before to after blowoff and toner mass is obtained. Tribo is defined as toner charge/toner mass. PS means paint shake. Developer is placed in a glass jar. The glass jar with developer is placed in a paint shaker and agitated for 15 mins and 60 mins. The action of the paint shaker mimics the abuse experienced by a toner in a developer sump in a machine. Tribo generally falls with time as toner constituents move to the carrier and the surfaces become more alike and as additives are impacted into the toner surface. The object of toner design is to minimize the change in tribo with time. Thus, of the 8 designs above, design 4 is most advantaged for tribo stability.

Cohesion is measured with a Hosokawa Cohesion tester. This consists of 3 screens with different meshings—53 microns/45microns/38 microns. The screens are placed one atop the other and vibrated for 1 minute. The amount of toner remaining in each screen is an indication of the stickiness (cohesiveness) the toner. Cohesion is a relative value. A cohesion of 0 means liquid flow (no toner remained on any screen) while a cohesion of 100 means no toner moved through any screen. The toner is 5.5 μm and the screens are 53/45/38 microns, so the most cohesive the toner, the larger the toner agglomerates that cannot pass through the mesh openings. The goal in toner design is to have as low a cohesion as possible when the toner is released from the additive blending operation—and to have that cohesion remain as low as possible as the toner is aged in a developer housing in a machine.

What is claimed is:

1. A black toner comprising toner particles comprised of at least one binder, at least one black colorant, and a package of external additives, wherein the at least one binder includes a styrene acrylate binder including a cross-linked styrene acrylate gel content of from 0% to about 15% by weight of the binder, and wherein the external additives include from about 0.2 to about 5.0% by weight of the toner particles of a first silica having an average particle size of from about 35 to about 45 nm, from about 0.2 to about 3.0% by weight of the toner particles of a second silica having an average particle size of from about 135 to about 160 nm, and from about 0.2 to about 5.0% by weight of the toner particles of a titania having an average particle size of from about 35 to about 45 nm.

2. The black toner according to claim 1, wherein the external additives further include from about 0.2 to about 5.0% by weight of the toner particles of a third silica having an average particle size of from about 8 to about 20 nm.

3. The black toner according to claim 1, wherein the at least one black colorant includes carbon black.

4. The black toner according to claim 1, wherein the second silica of the external additives is a sol-gel silica.

5. The black toner according to claim 1, wherein the styrene acrylate binder is an emulsion aggregation styrene acrylate binder.

6. The black toner according to claim 1, wherein the toner particles have an average particle size of from about 4 to about 7 μm.

7. The black toner according to claim 1, wherein the toner particles further comprise from about 2 to about 25% by weight of the toner particles of a wax.

8. The black toner according to claim 1, wherein the cross-linked styrene acrylate gel content of the styrene acrylate binder is from about 5% to about 11% by weight of the binder.

9. The black toner according to claim 1, wherein the black toner has, following triboelectric contact with carrier particles comprising a core of ferrite coated with a polymethyl methacrylate polymer or copolymer, carbon black and melamine beads, a triboelectric charge of from about −25 to about −80 μC/g.

10. A developer comprising the black toner of claim 1 and carrier particles comprising a core of ferrite coated with a coating comprising a polymethyl methacrylate polymer or copolymer, carbon black and melamine beads, wherein the developer comprises from about 1 part to about 25 parts by weight of the black toner and from about 75 parts to about 99 parts by weight of the carrier particles.

11. The developer according to claim 10, wherein the carrier particles have an average diameter of from about 30 to about 55 μm.

12. The developer according to claim 10, wherein the coating on the carrier particles includes from about 70 to about 80% by weight of the polymethyl methacrylate polymer, from about 6 to about 12% by weight of the carbon black and from about 8 to about 12% by weight of the melamine beads.

13. The developer according to claim 12, wherein the coating on the carrier particles further includes from about 3 to about 9% of a fluoro-copolymer.

14. The developer according to claim 10, wherein the melamine beads have a size of from about 100 to about 300 nm.

15. An electrophotographic image forming apparatus comprising a photoreceptor, a semiconductive magnetic brush development system, and a housing in association with the semiconductive magnetic brush development system, wherein the housing contains a developer comprising the black toner according to claim 1.

* * * * *

UNITED STATES PATENT AND TRADEMARK OFFICE

CERTIFICATE OF CORRECTION

PATENT NO. : 7,157,200 B2
APPLICATION NO. : 10/839293
DATED : January 2, 2007
INVENTOR(S) : Mary McStravick et al.

It is certified that error appears in the above-identified patent and that said Letters Patent is hereby corrected as shown below:

Title Page, Item (12), line 2:
Please change "Mc Stravick" to read --McStravick--

Item (75), line 1:
Please change "Mc Stravick" to read --McStravick--

Signed and Sealed this

Twenty Second Day of April, 2008

JON W. DUDAS
*Director of the United States Patent and Trademark Office*